US007698880B2

(12) United States Patent
Kasahara et al.

(10) Patent No.: US 7,698,880 B2
(45) Date of Patent: Apr. 20, 2010

(54) COIN WRAPPING MACHINE

(75) Inventors: Hisato Kasahara, Ichihara (JP); Yasuyuki Nakagawa, Tokyo (JP); Kiichiro Ikedaka, Tokyo (JP)

(73) Assignee: Laurel Precision Machines Co., Ltd., Osaka-shi (JP)

( * ) Notice: Subject to any disclaimer, the term of this patent is extended or adjusted under 35 U.S.C. 154(b) by 155 days.

(21) Appl. No.: 11/905,709

(22) Filed: Oct. 3, 2007

(65) Prior Publication Data

US 2008/0083194 A1 Apr. 10, 2008

(30) Foreign Application Priority Data

Oct. 6, 2006 (JP) ..... P2006-275053

(51) Int. Cl.
*G07D 13/00* (2006.01)
*B65B 57/20* (2006.01)

(52) U.S. Cl. ..... 53/500; 53/498; 53/532; 194/330

(58) Field of Classification Search ..... 53/52, 53/58, 498, 500, 152, 532; 194/302, 328, 194/330; 453/58, 59, 61, 62, 63
See application file for complete search history.

(56) References Cited

U.S. PATENT DOCUMENTS 4,850,469 A 7/1989 Hayashi et al.
4,896,481 A 1/1990 Sentoku et al.
5,499,483 A 3/1996 Oikawa
6,328,150 B1 12/2001 Hibari
6,497,085 B2 * 12/2002 Fukumoto et al. ..... 53/501
2002/0112455 A1 8/2002 Sugahara et al.

FOREIGN PATENT DOCUMENTS

DE 10052387 A1 * 5/2002 ..... 53/532
EP 0 660 278 A 6/1995
EP 1 049 054 A 11/2000
JP 11232518 * 8/1999 ..... 53/532
JP 2001-143121 5/2001
KR 1996-0011499 8/1996
KR 0108781 12/1996
KR 2002-0029779 4/2002

* cited by examiner

*Primary Examiner*—Rinaldi I. Rada
*Assistant Examiner*—John Paradiso
(74) *Attorney, Agent, or Firm*—Nixon & Vanderhye P.C.

(57) ABSTRACT

A coin wrapping machine includes a discrimination unit which detects images of the front face and rear face of coins during conveyance, and which discriminates the coins, a sorting unit which sorts the coins to one of a first side and a second side based on the discrimination results of the discrimination unit, a stacking unit which stacks the coins sorted to the first side by this sorting unit into columnar form with a prescribed number of coins, a wrapping unit which wraps stack of coins in columnar form, and a controller which controls the sorting unit based on the discrimination results so that at least one of an outside face of a coin at one end of the stack of coins and a second outside face of a coin at the other end of the stack of coins is the rear face.

15 Claims, 3 Drawing Sheets

COIN WRAPPING MACHINE

BACKGROUND OF THE INVENTION

1. Field of the Invention

The present invention relates to a coin wrapping machine which discriminates, counts, and wraps coins.

Priority is claimed on Japanese Patent Application No. 2006-275053, filed on Oct. 6, 2006, the content of which is incorporated herein by reference.

2. Description of Related Art

Coin wrapping machines discriminate the genuineness, denomination and the like of loose coins. Based on the results of discrimination, only a specified number of coins (usually 50) of only a specified denomination are stacked from among the genuine coins. The stack of coins is wound in wrapping paper to obtain wrapped coins. In order to accurately conduct the discrimination, the coin wrapping machine recorded in Japanese Unexamined Patent Application, First Publication Number 2001-143121 photographs the coins, and conducts discrimination based on the detected images.

There are coins which are issued by multiple issuing countries, which form patterns on the front face common to all issuing countries containing the coin denomination information, and which form patterns on the rear face unique to each issuing country (Euro coins). The coin discriminating apparatus recorded in Japanese Unexamined Patent Application, First Publication Number 2000-306135 photographs the front and rear faces of the coins in order to sort such coins by denomination and by issuing country, and conducts discrimination based on the detected images of both faces.

Conventional coin wrapping machines stack and wrap coins of the same denomination. Accordingly, they do not assume the occurrence of multiple types of coins which form a pattern on the front face common to all issuing countries containing the denomination information, and which form a pattern on the rear face that differs by issuing country, as with the aforementioned Euro coins.

Consequently, it is problematic to use conventional coin wrapping machines in order to wrap such coins by denomination and by issuing country. For example, in the case where a stack of coins is wrapped with the two end faces of the stack of coins are both the rear faces of the coin, there is no problem, because the issuing country is known from the pattern of the rear face, and the denomination is also clear from the size, color and the like. However, in the case where a stack of coins is wrapped with the two end faces of the stack of coins are both the front faces of the coin, although the denomination is known from the pattern of this front face, the issuing country of the coin is unclear.

SUMMARY OF THE INVENTION

An object of the present invention is to provide a coin wrapping machine which conducts wrapping so that the issuing country is unfailingly known after wrapping, even in the case where coins are wrapped which form a pattern on the front face common to all issuing countries containing the denomination information, and which form a pattern on the rear face that differs by issuing country.

In order to achieve the aforementioned object, in a coin wrapping machine which wraps coins that form a common pattern, which contains denomination information, on a front face and that form a pattern on a rear face that differs according to a plurality of issuing countries, the coin wrapping machine according to a first aspect of the present invention includes: a supply unit which dispenses deposited coins one-by-one; a coin conveyance unit which conveys the coins dispensed from said supply unit; a discrimination unit which detects images of the front face and the rear face of the coins conveyed by said coin conveyance unit, discriminates the coins, and obtains discrimination results; a sorting unit which sorts the coins conveyed by said coin conveyance unit to one of a first side and a second side based on the discrimination results; a stacking unit which stacks the coins sorted to the first side by said sorting unit into columnar form with a prescribed number of coins; a wrapping unit which wraps a stack of coins stacked into the columnar form by said stacking unit; and a controller which controls said sorting unit so that at least one of a first outside face of a first coin at one end of the stack of coins and a second outside face of a second coin at the other end of the stack of coins is the rear face.

In a second aspect of the present invention, said controller controls said sorting unit so that the first outside face is the rear face.

In the second aspect of the present invention, said controller may also control said sorting unit so that the second outside face is the front face.

In a third aspect of the present invention, said controller controls said sorting unit so that said first outside face may be one of the front face and the rear face, and so that the second outside face is the rear face only when the first outside face is the front face.

In a fourth aspect of the present invention, said controller controls said sorting unit so that the first outside face may be one of the front face and the rear face, and so that the second outside face is opposite in front-rear face of coin to the first outside face.

The aforementioned coin wrapping machine may also comprise a return conveyance unit which resupplies the coins sorted to the second side by said sorting unit to said supply unit.

The aforementioned coin wrapping machine may comprise a control panel which input a start command in order to start wrapping processing, wherein upon input of the start command by said control panel, said controller designate a type of a coin initially discriminated by said discrimination unit to a set type subject to the wrapping processing.

According to the first aspect of the present invention, coins are wrapped which form a common pattern, which contains denomination information, on a front face and which form a pattern on a rear face that differs according to a plurality of issuing countries. In this process, a controller controls a sorting unit based on discrimination results of a discrimination unit so that at least one of the faces among a first outside face and a second outside face which are the end faces of the stack of coins configured by stacking a prescribed number of coins into a columnar shape by a stacking unit is always the rear face which forms the pattern that differs by issuing country.

Specifically, for example, in the case where it is judged based on the discrimination results of the discrimination unit that the coin to be stacked first in the stacking unit is being conveyed by the coin conveyance unit with an orientation where a face that would be the first outside face of the stack of coins (the face formed by the coin to be stacked first when fed into the stacking unit, and also the face which is one of the end faces of the stack of coins) is the rear face of the coin, the controller has that coin sorted to the first side by the sorting unit, and fed to the stacking unit.

On the other hand, in the case where it is judged based on the discrimination results of the discrimination unit that the coin to be stacked first in the stacking unit is being conveyed by the coin conveyance unit with an orientation where a face that would be the first outside face is not the rear face of the coin (that is, the front face of the coin), the controller has that coin sorted to the second side by the sorting unit.

Or, in the case where it is judged based on the discrimination results of the discrimination unit that the coin to be stacked last in the stacking unit is being conveyed by the coin conveyance unit with an orientation where a face that would be the second outside face of the stack of coins (the face formed by the coin to be stacked last when fed into the stacking unit, and also the face which is the other end face of the stack of coins) is the rear face of the coin, the controller has that coin sorted to the first side by the sorting unit, and fed to the stacking unit.

On the other hand, in the case where it is judged based on the discrimination results of the discrimination unit that the coin to be stacked last by the stacking unit is being conveyed by the coin conveyance unit with an orientation where a face that would be the second outside face is the front face of the coin, the controller has that coin sorted to the second side by the sorting unit.

The wrapping unit wraps the stack of coins which has been stacked in this manner. Consequently, wrapped coins are able to be wrapped so that the issuing country is unfailingly understood after wrapping, because, of the two coins at the two ends of the stack of coins, the outside face of at least one of the coins of the columnar stack of coins is always the rear face where the pattern that differs by issuing country is formed.

According to the second aspect of the present invention, the controller controls the sorting unit so that the first outside face of the stack of coin is always the rear face where the pattern that differs by issuing country is formed.

Specifically, for example, in the case where it is judged based on the discrimination results of the discrimination unit that the coin to be stacked first by the stacking unit is being conveyed with the first outside face oriented to the rear face of the coin, the controller has that coin sorted to the first side by the sorting unit, and fed to the stacking unit.

On the other hand, in the case where it is judged based on the discrimination results of the discrimination unit that the coin to be stacked first by the stacking unit is being conveyed with the first outside face not oriented to the rear face of the coin, the controller has that coin sorted to the second side by the sorting unit.

In this manner, even though a coin which is being conveyed such that one of the outside faces of the columnar stack of coin would not be a rear coin face is sorted to the second side, it can be sorted to the beginning of stacking. Consequently, this coin can be quickly returned to the supply unit to be provided for subsequent stacking.

The controller according to the second aspect of the present invention controls the sorting unit in the aforementioned manner so that the first outside face of the stack of coins is always the rear face where the pattern that differs by issuing country is formed. Subsequently, the sorting unit may be controlled so that the second outside face of the stack of coins is always the front face where the pattern common to all issuing countries including denomination information is formed.

Specifically, in the case where it is judged based on the discrimination results of the discrimination unit that the coin to be stacked last in the stacking unit is being conveyed by the coin conveyance unit with an orientation where a face that would be the second outside face is the front face of the coin, the controller has that coin sorted to the first side by the sorting unit, and fed to the stacking unit.

On the other hand, in the case where it is judged based on the discrimination results of the discrimination unit that the coin to be stacked last in the stacking unit is being conveyed by the coin conveyance unit with an orientation where a face that would be the second outside face is not the front face (that is, the rear face) of the coin, the controller has that coin sorted to the second side by the sorting unit.

Accordingly, the first outside face of the stack of coins is always the rear face, and the second outside face of the stack of coins is the front face of the coin. Consequently, it is possible to conduct wrapping so that the issuing country is unfailingly known after wrapping, and so that the denomination is also easily known.

According to the third aspect of the present invention, the controller controls the sorting unit so that the first outside face of the stack of coins may be the front face or the rear face of the coin. In addition, the sorting unit is controlled so that the second outside face of the stack of coins is the rear face of the coin only when the first outside face is not the rear face where the pattern that differs by issuing country is formed (when it is the front face).

Specifically, in the case where it is judged based on the discrimination results that the coin to be stacked last by the stacking unit is being conveyed by the coin conveyance unit with an orientation where a face that would be the second outside face is the rear face of the coin, the controller has that coin sorted to the first side by the sorting unit, and fed to the stacking unit.

On the other hand, in the case where it is judged based on the discrimination results of the discrimination unit that the coin to be stacked last by the stacking unit is being conveyed by the coin conveyance unit with an orientation where a face that would be the second outside face is not the rear face of the coin, the controller has that coin sorted to the second side by the sorting unit.

Accordingly, it is possible to reduce the possibility that the coin is sorted to the second side due to the orientation of the coin during conveyance on the conveyance path.

According to the fourth aspect of the present invention, the controller may make the first outside face of the stack of coins either the front face or the rear face of the coin. In addition, the sorting unit is controlled so that the second outside face is opposite in front-rear face of coin to the first outside face.

Specifically, this is as follows. First, there is the case where the first outside face of the stack of coins is a front face. In this case, one may subsequently divide matters in two as follows.

First, there is the case where it is judged based on the discrimination results of the discrimination unit that the coin to be stacked last by the stacking unit is being conveyed by the coin conveyance unit with an orientation where a face that would be the second outside face of the stack of coins is the rear face of the coin. In this case, the controller has that coin sorted to the first side by the sorting unit, and fed to the stacking unit.

Second, there is the case where it is judged based on the discrimination results of the discrimination unit that the coin to be stacked last by the stacking unit is being conveyed by the coin conveyance unit with an orientation where a face that would be the second outside face the stack of coins is the front face of the coin. In this case, the controller has that coin sorted to the second side by the sorting unit.

Next, there is the case where the first outside face of the stack of coins is the rear face of the coin. In this case, as well, one may subsequently divide matters in two as follows.

First, there is the case where it is judged based on the discrimination results of the discrimination unit that the coin to be stacked last by the stacking unit is being conveyed by the coin conveyance unit with an orientation where a face that would be the second outside face of the stack of coins is the front face of the coin. In this case, the controller has that coin sorted to the first side by the sorting unit, and fed to the stacking unit.

Second, there is the case where it is judged based on the discrimination results of the discrimination unit that the coin to be stacked last when fed into the stacking unit is being conveyed by the coin conveyance unit with an orientation where a face that would be the second outside face is not the front face of the coin. In this case, the controller has that coin sorted to the second side by the sorting unit.

By conducting control in this manner, one of the outside faces of the stack of coins is always the front face of the coin, and the other outside face is the rear face of the coin. Consequently, it is possible to conduct wrapping so that the issuing country is unfailingly known after wrapping. Moreover, it is also possible to conduct wrapping so that the denomination is easily known.

The above-described coin wrapping machine may also have a return drive unit which resupplies the coins sorted to the second side by the sorting unit to the supply unit. Accordingly, using the return drive unit, it is possible to automatically return coins which have been sorted to the second side for reasons of coin orientation to the supply unit to be provided for subsequent stacking.

The above-described coin wrapping machine has a control panel which inputs a start command in order to start wrapping processing, and—after input of the start command by the control panel—allows setting of a set type subject to processing where the type of coin initially discriminated by the discrimination unit is wrapped. By this means, setting operations for a set type subject to processing are rendered unnecessary, and simplification of operations is achieved.

DETAILED DESCRIPTION OF THE INVENTION

Figure 1:
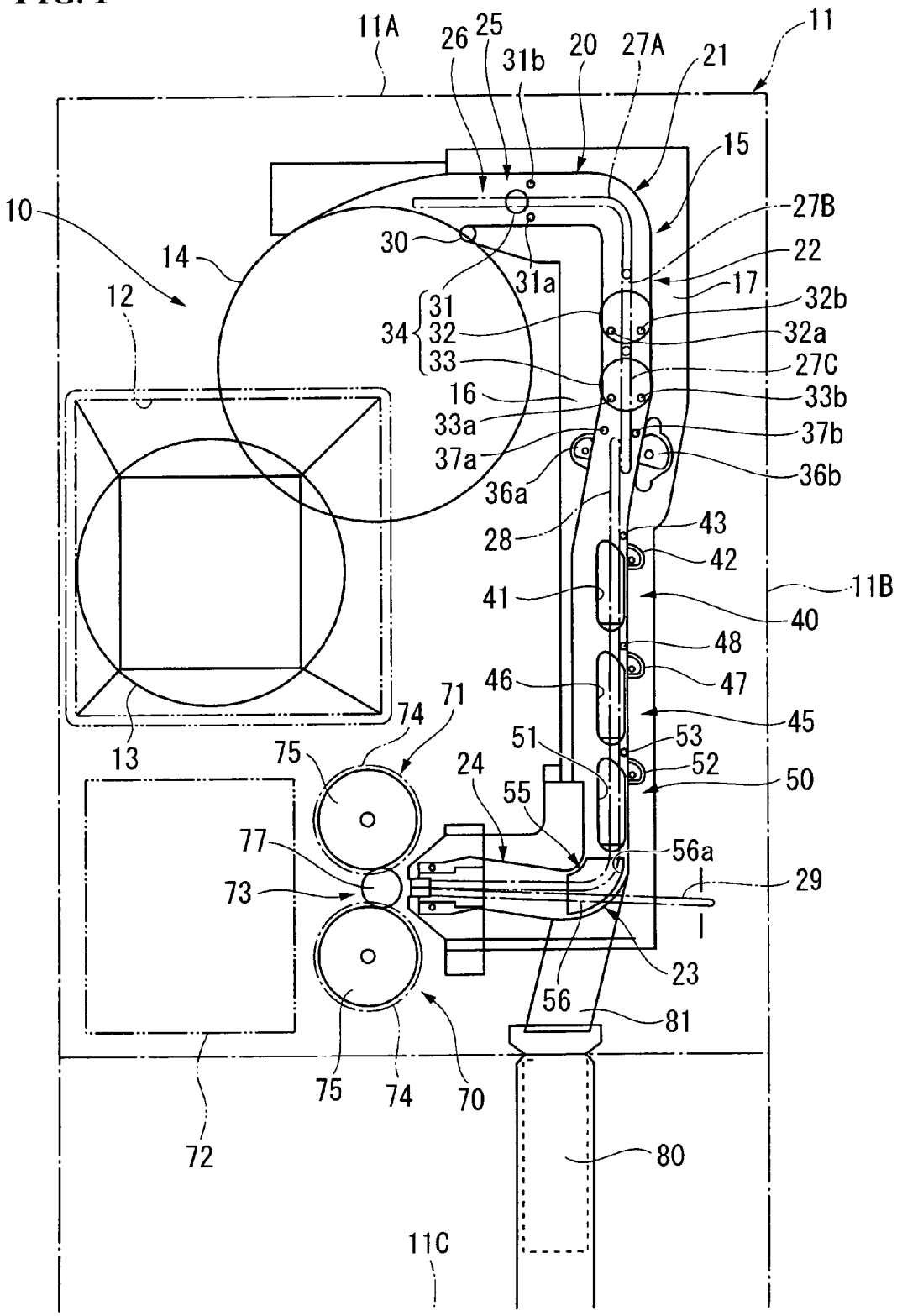
FIG. 1 is a plan view showing the coin wrapping machine according to a first embodiment of the present invention.

The coin wrapping machine according to the first embodiment of the present invention is described below with reference to drawings.

The coin wrapping machine of the first embodiment is a coin wrapping machine which wraps coins which form an impression of a pattern containing denomination information on the front face, and which form an impression of a pattern that differs by the respective issuing country on the rear face, namely, Euro coins. Euro coins vary in diameter by denomination, and some Euro coins also vary in coloration (material) among denominations. Consequently, the denomination is known merely by means of diameter and coloration apart from the pattern of the front face containing denomination information.

The coin wrapping machine of the first embodiment is capable of processing in a wrapping mode and processing in a counting mode. In the processing of the wrapping mode, the loose change that is introduced is counted by type, and only coins of identical type which are of the set type subject to processing are collected and wrapped. In the processing of the counting mode, the loose change that is introduced is counted by type, and only coins of identical type which are of the set type subject to processing are collected. With respect to identical types, there is the mode that integrates issuing countries where the identical type is set by means of the same denomination regardless of issuing country, and the mode that differentiates issuing countries where the identical type is set by means of the same denomination and the same issuing country.

In the state where the wrapping mode that differentiates issuing countries is selected, discrimination of genuineness, quality, denomination and issuing country is conducted, and counting is conducted with respect to the allotted loose coins. Based on these discrimination results, coins of the set type subject to processing are accepted, which are genuine and regular and which are of the prescribed type (same denomination and same issuing country). Counterfeit coins and coins which are genuine but disfigured are ejected to the outside of the machine. Coins different from the set type subject to processing are temporarily stored, which are genuine and regular, and which are of not prescribed type. Furthermore, accepted coins of the set type subject to processing are wrapped in units of a prescribed number.

In the state where the wrapping mode that integrates issuing countries is selected, discrimination of genuineness, quality and denomination is conducted, and counting is conducted with respect to the allotted loose coins. Based on these discrimination results, coins of the set type subject to processing are accepted which are genuine and regular and which are of the prescribed type (same denomination regardless of issuing country). Counterfeit coins and coins which are genuine but disfigured are ejected to the outside of the machine. Coins different from the set type subject to processing are temporarily stored which are genuine and regular, and which are of not prescribed type. Furthermore, accepted coins of the set type subject to processing are wrapped in units of a prescribed number.

In the wrapping mode, it is possible to sequentially conduct the following processing. First, among the allotted loose coins, the coins of the set type subject to processing, which are genuine and regular, and which are of the prescribed identical type, are wrapped. On the other hand, coins different from the set type subject to processing, which are genuine and regular, and which are of other types, are temporarily stored. Next, when the wrapping of coins of the set type subject to processing, which are of said prescribed identical type, is completed, coins of another prescribed type are subsequently set as the set type subject to processing from among the temporarily stored coins different from said set type subject to processing. Next, the coins of this set type subject to processing are wrapped.

In the counting mode, the following processing is sequentially conducted. Among the allotted loose coins, coins of the set type subject to processing, which are genuine and regular and which are of the prescribed identical type, are counted, and are dispensed so as to be ejected outside the machine. On the other hand, coins of different from the set type subject to processing, which are genuine and regular, and which are of other types, are temporarily stored. Next, when the counting and dispensing of coins of the set type subject to processing, which are of said prescribed identical type, are completed, coins of another prescribed type are subsequently set as the set type subject to processing from among the temporarily stored coins different from said set types subject to processing. Next, the coins of this set type subject to processing are counted and dispensed.

As shown in FIG. 1, this coin wrapping machine is formed in the shape of an approximately rectangular parallelepiped.

A hopper 12 into which an operator deposits loose coins is provided on the upper face of the machine body 11. On the underside of this hopper 12 is provided a coin supply unit (supply unit) 10 which dispenses the deposited coins one-by-one.

The coin supply unit 10 has a supply disk 13 and rotary disk 14. The supply disk 13 is capable of rotating around a vertical axis to which the loose coins are directed from the hopper 12. The rotary disk 14 is provided beside this supply disk 13, and is capable of rotating around a vertical axis. This rotary disk 14 receives the loose coins which are dispensed by centrifugal force from the supply disk 13. Furthermore, by having these received coins transit a separator (not shown in the drawings) by centrifugal force, they are dispensed to a coin channel 15 that serves to individually guide the coins. This supply disk 13 and rotary disk 14 are driven forward and in reverse by a supply drive unit 101 containing a motor (not shown) controlled by a control device (controller) 100 shown in FIG. 2.

The coin channel 15 guides the coins dispensed from the rotary disk 14 on a channel face between guides 16 and 17 which are raised on both sides. This coin channel 15 is horizontally arranged so as to enclose the rotary disk 14 along the rear face 11A, side face 11B and front face 11C of the machine body 11.

The coin channel 15 is connected to the rotary disk 14. Furthermore, the coin channel 15 has a first linear part 20, first bent part 21, second linear part 22, second bent part 23, and third linear part 24. The first linear part 20 is arranged along the rear face 11A in a space between the rotary disk 14 and rear face 11A. The first bent part 21 is connected to the opposite side of the first linear part 20 relative to the rotary disk 14, and bends perpendicularly in the direction of the rotary disk 14 relative to the first linear part 20. The second linear part 22 is connected to the opposite side of the first bent part 21 relative to the first linear part 20, and consequently forms a right angle relative to the first linear part 20. The second bent part 23 is connected to the opposite side of the second bent part 22 relative to the first bent part 21, and bends perpendicularly in the direction of the rotary disk 14 relative to the second linear part 22. The third linear part 24 is connected to the opposite side of the second bent part 23 relative to the second linear part 22, and consequently forms a right angle relative to the second linear part 22. A conveyance mechanism 26 is provided in the vicinity of the coin channel 15. This conveyance mechanism 26 conveys the coins dispensed form the coin supply unit 10 onto the coin channel 15 along this coin channel 15. A coin conveyance unit 25 which conveys coins dispensed from the coin supply unit 10 is configured by the coin channel 15 and conveyance mechanism 26.

The conveyance mechanism 26 has a conveyor belt 27A, conveyor belt 27B, conveyor belt 27C, and conveyor belt 28. The conveyor belt 27A is provided on the upper side of the coin channel 15, and moves coins dispensed from the rotary disk 14 along the first linear part 20, first bent part 21, and part of the second linear part 22. The conveyor belt 27B is provided on the lower side of the coin channel 15, and moves coins conveyed by conveyor belt 27A further along part of the second linear part 22. The conveyor belt 27C is provided on the upper side of the coin channel 15, and moves coins conveyed by conveyor belt 27B further along part of the second linear part 22. The conveyor belt 28 is provided on the upper side of the coin channel 15, and moves coins conveyed by conveyor belt 27C along the remainder of the second linear part 22, second bent part 23, and third linear part 24. The conveyance mechanism 26 has a motor (not shown) of a conveyance drive unit 102 shown in FIG. 2 which is controlled by the control device 100, and a belt 29 that serves to transmit the motive force from this motor to the conveyor belts 27A-27C and 28. By this means, the conveyance mechanism 26 is capable of conducting forward and reverse driving with interlocking of these conveyor belts 27A-27C and 28 and belt 29.

A freely rotatable guide roller 30 is provided between the rotary disk 14 and the first linear part 20 of the coin channel 15, at the tip of one of the guides 16. By means of this guide roller 30, coins which strike the tip of this guide 16 and are detained by it are either returned to the interior of the rotary disk 14, or tend to be guided toward the coin channel 15.

In the first linear part 20 constituting the upstream side in the coin conveyance direction of the coin channel 15, a material detection sensor 31 is arranged so as to configure part of the channel face of the coin channel 15. This material detection sensor 31 detects coins conveyed on the first linear part 20 based on the magnetic properties of the coin material. Coin detection sensors 31*a* and 31*b* are provided on the two sides of the material detection sensor 31. These coin detection sensors 31*a* and 31*b* count the timing of detection data intake by this material detection sensor 31. As a result of this configuration, the control device 100 has the material detection sensor 31 conduct intake of detection data at the point when a coin is jointly detected by these coin detection sensors 31*a* and 31*b*.

An upper image detector 32 is arranged on the first bent part 21 side of the second linear part 22 of the coin channel 15, at the position of conveyor belt 27B provided on the lower side. This upper image detector 32 is a CCD area sensor or the like, and detects images of coins conveyed by the second linear part 22 from the upper side. Coin detection sensors 32*a* and 32*b* are provided on the two sides of the upper image detector 32. These coin detection sensors 32*a* and 32*b* count the timing of detection data intake by this upper image detector 32. As a result of this configuration, the control device 100 has the upper image detector 32 conduct intake of detection data at the point when a coin is jointly detected by these coin detection sensors 32*a* and 32*b*.

A lower image detector 33 is arranged on the downstream side from the upper image detector 32 of the second linear part 22 of the coin channel 15, at the position of conveyor belt 27C provided on the upper side, so as to configure part of the channel face of the coin channel 15. This lower image detector 33 is a CCD area sensor or the like, and detects images of coins conveyed by the second linear part 22 from the lower side. Coin detection sensors 33*a* and 33*b* are provided on the two sides of the lower image detector 33. These coin detection sensors 33*a* and 33*b* count the timing of detection data intake by this lower image detector 33. As a result of this configuration, the control device 100 has the lower image detector 33 conduct intake of detection data at the point when a coin is jointly detected by these coin detection sensors 33*a* and 33*b*.

As described above, the discrimination unit 34—which is composed by the material detection sensor 31, upper image detector 32, and lower image detector 33 that serve to discriminate coins on the coin channel 15—detects images of the front face and rear face of the coins during conveyance by the coin conveyance unit 25, and discriminates the coins. This discrimination unit 34 is arranged so as to span the first linear part 20 and second linear part 22 of the coin channel 15.

The outputs of the material detection sensor 31, upper image detector 32, and lower image detector 33 are inputted to the control device 100. In this control device 100, for example, the detection data pertaining to coins detected by the material detection sensor 31 on the upstream side is sequentially compared with reference data on the coin material of each denomination. In the case where this results in a determination that the detection data of the material does not match any reference data on the coin material of the denominations, it is discriminated at that point that the detected coin is a false coin.

On the other hand, the control device 100 conducts the following procedure in the case where it is determined from the detection results of the material detection sensor 31 that there is a match with reference data pertaining to the coin material of any of the denominations. First, the reference pattern data for the front/rear images of the coin of the denomination pertaining to the matched material is read out. Next, a comparison is made between the reference pattern data of these images and the detected pattern data of the upper image detector 32 and the detected pattern data of the lower image detector 33 relative to this detected coin, and it is detected whether or not there is a match with the respective pattern data of the front/rear images of the coin and the external diameter of the coin. If this results in the determination of a match between the detected pattern data and the reference pattern data of the respective front/rear images, and of a match between these external diameters, it is determined that this detected coin is a true coin of the detected denomination. On the other hand, if the determination is made that there is not a match with the reference pattern data of at least one of the front or rear images, or that the external diameters do not match, it is determined that this detected coin is a false coin.

The processed coin has a pattern common to all issuing countries on one face relative to the same denomination, and a pattern which differs by issuing country on the opposite face. Accordingly, at the time of discrimination, a determination is made that the pattern common to all issuing countries on one face matches the master data common to all issuing countries. On the other hand, it is determined that the pattern on the opposite face that differs by issuing country matches the master data by issuing country. As a result, if the pattern common to all issuing countries matches the master data, and if the pattern that differs by issuing country matches the master data pertaining to the pattern of any of the issuing countries, a determination is made that this is a true coin.

The control device 100 determines the coincidence of the detected pattern data with the reference pattern data with respect to both the top and edge, that is, the front and rear of the detected coin. As a result, when there is matching of a prescribed coincidence or greater, and when the error of the external coin diameter of the detected pattern relative to the external coin diameter of the reference pattern data is within the allowable range, it is determined that these coincidences are high, and that this is a normal and true coin. On the other hand, if the detected pattern data does not match the reference pattern data with respect to either the top or bottom, that is, the front or rear of the detected coin to the prescribed coincidence or greater, or if the error of the external coin diameter of the detected pattern relative to the external coin diameter of the reference pattern data is not within the allowable range, the control device 100 determines that these coincidences are low, and that this is an abnormal and false coin.

In addition, the control device 100 compares, for example, the coincidence of the coloration of the detected pattern data with that of the reference pattern data with respect to both the top and bottom, that is, the front and rear of the detected coin that was determined to be a true coin as described above. As a result, in the case where there is matching of coloration to the prescribed coincidence or greater, it is determined that staining is within the allowable range, and is normal. On the other hand, in the case where the matching of coloration does not occur to the prescribed coincidence or greater, it is determined that staining is not within the allowable range, and is abnormal, and the detected coin is determined to be a stained coin.

Furthermore, the control device 100 determines whether or not there are parts where the coincidence of the reference pattern data and the detected pattern data is locally below the prescribed proportion with respect to both the top and bottom, that is, the front and rear of the detected coin which was determined to be a true coin as described above. As a result, in the case where there are no parts where coincidence is locally below the prescribed proportion, it is determined that the degree of damage is within the allowable range, and is normal. On the other hand, in the case where there are parts where coincidence is locally below the prescribed proportion, it is determined that damage is not within the allowable range, and is abnormal, and the detected coin is determined to be a locally damaged coin.

In addition, the control device 100 detects the deformation (roundness) of the external diameter part of the coin from the detected data with respect to both the top and bottom, that is, the front and rear of the detected coin which was determined to be a true coin as described above. As a result, in the case where the degree of deformation of the external diameter part is less than the prescribed value, it is determined that deformation is within the allowable range, and is normal. On the other hand, in the case where the degree of deformation is at the prescribed value or higher, it is determined that deformation is not within the allowable range, and is abnormal, and the detected coin is determined to be a generally damaged coin.

From the foregoing results, the control device 100 determines that coins among the true coins which fall under any one of the categories of stained coins, locally damaged coins or generally damaged coins are defaced coins. It further determines false coins and defaced coins to be abnormal coins. On the other hand, it determines that coins among the true coins which do not fall under any one of the categories of stained coins, locally damaged coins or generally damaged coins are regular coins.

On the downstream side from the lower image detector 33 of the second linear part 22, stopper members 36*a* and 36*b* are provided on both sides of the second linear part 22 so as to sandwich it. These stopper members 36*a* and 36*b* come into contact with the coins on the second linear part 22 from the downstream side, and stop these coins. Moreover, the stopper members 36*a* and 36*b* are rotated forward and backward at a prescribed angle by a stopper drive unit 103 shown in FIG. 2 which includes a rotary solenoid (not shown).

These stopper members 36*a* and 36*b* function, firstly, as stoppers for counting during wrapping. On such occasions, when the required coin type reaches the prescribed number of coins, the stopper members 36*a* and 36*b* are both simultaneously made to project into the second linear part 22 by the control of the control device 100, thereby preventing the passage of coins conveyed on the second linear part 22 in excess of the prescribed number. These stopper members 36*a* and 36*b* function, secondly as stoppers for stopping abnormal coins. On such occasions, in the case where a conveyed coin is an abnormal coin which is other than true and regular, the stopper members 36*a* and 36*b* are both simultaneously made to project into the second linear part 22 by the control of the control device 100 immediately before the passage of this abnormal coin. By this means, the abnormal coin is contacted, and its passage is prevented. When functioning as stoppers for counting, after these stopper members 36*a* and 36*b* are operated, the control device 100 has the conveyor belts 27A-27C and 28 of the conveyance mechanism 26 undergo reverse rotation, thereby returning all coins which are on the upstream side of the stopper members 36*a* and 36*b* to the rotating disk 14.

At a position immediately before the stopper members 36*a* and 36*b* on the upstream side of the second linear part 22, coin detecting sensors 37*a* and 37*b* are provided which serve to gauge the operational timing of the stopper drive unit 103 that drives these stopper members 36*a* and 36*b*. By means of this configuration, the control device 100 drives the stopper drive unit 103 at a timing where the target coins are jointly detected by these coin detecting sensors 37*a* and 37*b*, and compels the stopper members 36*a* and 36*b* to project into the second linear part 22. As a result, the stopper members 36*a* and 36*b* contact the target coins, and stop these coins.

A reject unit 40 is provided on the downstream side from the stopper members 36*a* and 36*b* on the second linear part 22. By means of this reject unit 40, it is possible to eject coins which are discriminated as abnormal coins from the detection results of the discrimination unit 34 composed of the material detection sensor 31, upper image detector 32, and lower image detector 33. This reject unit 40 has a reject aperture 41, reject projection 42 and reject drive unit 104. The reject aperture 41 is formed in the channel face of the second linear part 22. The reject projection 42 is provided on the guide 17 side at the terminus position of the reject aperture 41 on the upstream side in the coin conveyance direction, and is capable of projecting into the interior of the second linear part 22 and withdrawing from the interior of the second linear part 22. A reject drive unit 104 shown in FIG. 2 contains a rotary solenoid (not shown) which causes the reject projection 42 to rotate forward and backward at a prescribed angle.

In the state where the reject projection 42 is withdrawn from the interior of the second linear part 22, coins which transit the reject unit 40 move while being guided by contact with the guide 17 on whose side the reject projection 42 is provided. The conveyor belt 28 and coin channel 15 are set up to enable movement of the coins in this manner. The width of the reject aperture 41 is set narrower than the diameter of the smallest-diameter coins among the processed coins.

As a result of this configuration, when the control device 100 establishes the state where the reject projection 42 is withdrawn from the interior of the second linear part 22, the coins which always move in contact with the guide 17 are prevented from falling into the reject aperture 41. These coins pass by the reject aperture 41, and move further downstream on the second linear part 22. On the other hand, when the control device 100 drives the reject drive unit 104, and compels the reject projection 42 to project into the second linear part 22, the coins which have moved in contact with the guide 17 contact this reject projection 42. As a result of being pushed by this reject projection 42, the conveyance path of the coins is shifted so as to diverge from the guide 17. Consequently, the coins fall into the reject aperture 41.

A coin detecting sensor 43 is provided at a position immediately before the reject projection 42 on the upstream side of the second linear part 22. This coin detecting sensor 43 gauges the timing with which the reject projection 42 is driven. By means of this configuration, the control device 100 drives the reject drive unit 104 at a timing where the target coins are detected by this coin detecting sensor 43, and compels the reject projection 42 to project into the second linear part 22 only at the prescribed times. By this means, it is possible to have only these target coins fall into the reject aperture 41.

By making the reject projection 42 project into the second linear part 22 in the foregoing manner, the reject unit 40 compels coins which are discriminated as abnormal coins to fall into the reject aperture 41, and ejects them from the second linear part 22. On the other hand, by not making the reject projection 42 project into the second linear part 22, coins which are discriminated as true and regular do not fall into the reject aperture 41, and are conveyed further downstream on the second linear part 22.

Coins which fall into the reject aperture 41 are recovered by a reject box (not shown) arranged under this reject aperture 41. After the operator removes the reject box from the coin wrapping machine, the abnormal coins are extracted from this reject box.

A screening unit 45 is provided downstream from the reject unit on the second linear part 22. Based on the detection results of the upper image detector 32 and lower image detector 33, this screening unit 45 classifies true and regular coins as coins of the designated set type subject to processing and as coins of different from the set type subject to processing which is other than the set type subject to processing. Coins of the set type subject to processing are then made to pass further downstream on the coin channel 15. On the other hand, coins of different from the set type subject to processing are removed from the coin channel 15. This screening unit 45 has the same configuration as the reject unit 40, and includes a sorting aperture 46, sorting projection 47, and screening drive unit 105. The sorting aperture 46 is formed on the channel face of the second linear part 22. The sorting projection 47 is provided on the guide 17 side at the terminus position of the sorting aperture 46 on the upstream side in the coin conveyance direction, and is capable of projecting into the interior of the second linear part 22 and withdrawing from the interior of the second linear part 22. The screening drive unit 105 shown in FIG. 2 contains a rotary solenoid (not shown) which causes the sorting projection 47 to rotate forward and backward at a prescribed angle.

In the state where the sorting projection 47 is withdrawn from the interior of the second linear part 22, coins which transit the screening unit 45 move while being guided by contact with the guide 17 on whose side the sorting projection 47 is provided. The conveyor belt 28 and coin channel 15 are set up to enable movement of the coins in this manner. The width of the sorting aperture 46 is set narrower than the diameter of the smallest-diameter coins among the processed coins.

When the control device 100 establishes the state where the sorting projection 47 is withdrawn from the interior of the second linear part 22, the coins which always move in contact with the guide 17 are prevented from falling into the sorting aperture 46. These coins pass by the sorting aperture 46, and move further downstream on the second linear part 22. On the other hand, when the control device 100 drives the screening drive unit 105, and compels the sorting projection 47 to project into the second linear part 22, the coins which have moved in contact with the guide 17 contact this sorting projection 47. As a result of being pushed by this sorting projection 47, the conveyance path of the coins is shifted so as to diverge from the guide 17. Consequently, the coins fall into the sorting aperture 46.

A coin detecting sensor 48 is provided at a position immediately before the sorting projection 47 on the upstream side of the second linear part 22. This coin detecting sensor 48 gauges the timing with which the sorting projection 47 is driven. By means of this configuration, the control device 100 drives the screening drive unit 105 at a timing where the target coins are detected by this coin detecting sensor 48, and compels the sorting projection 47 to project into the second linear part 22 only at the prescribed times. By this means, it is possible to have only these target coins fall into the sorting aperture 46.

By making the sorting projection 47 project into the second linear part 22 in the foregoing manner, the screening unit 45 compels coins which are discriminated as true and regular but which are coins different from a set type subject to processing, which differ from the designated coins of the set type subject to processing, to fall into the sorting aperture 46, and ejects them from the second linear part 22. On the other hand, by not making the sorting projection 47 project into the second linear part 22, coins which are discriminated as true and regular coins and as coins of the set type subject to processing designated for wrapping or counting do not fall into the sorting aperture 46, and are conveyed further downstream on the second linear part 22.

Figure 2:
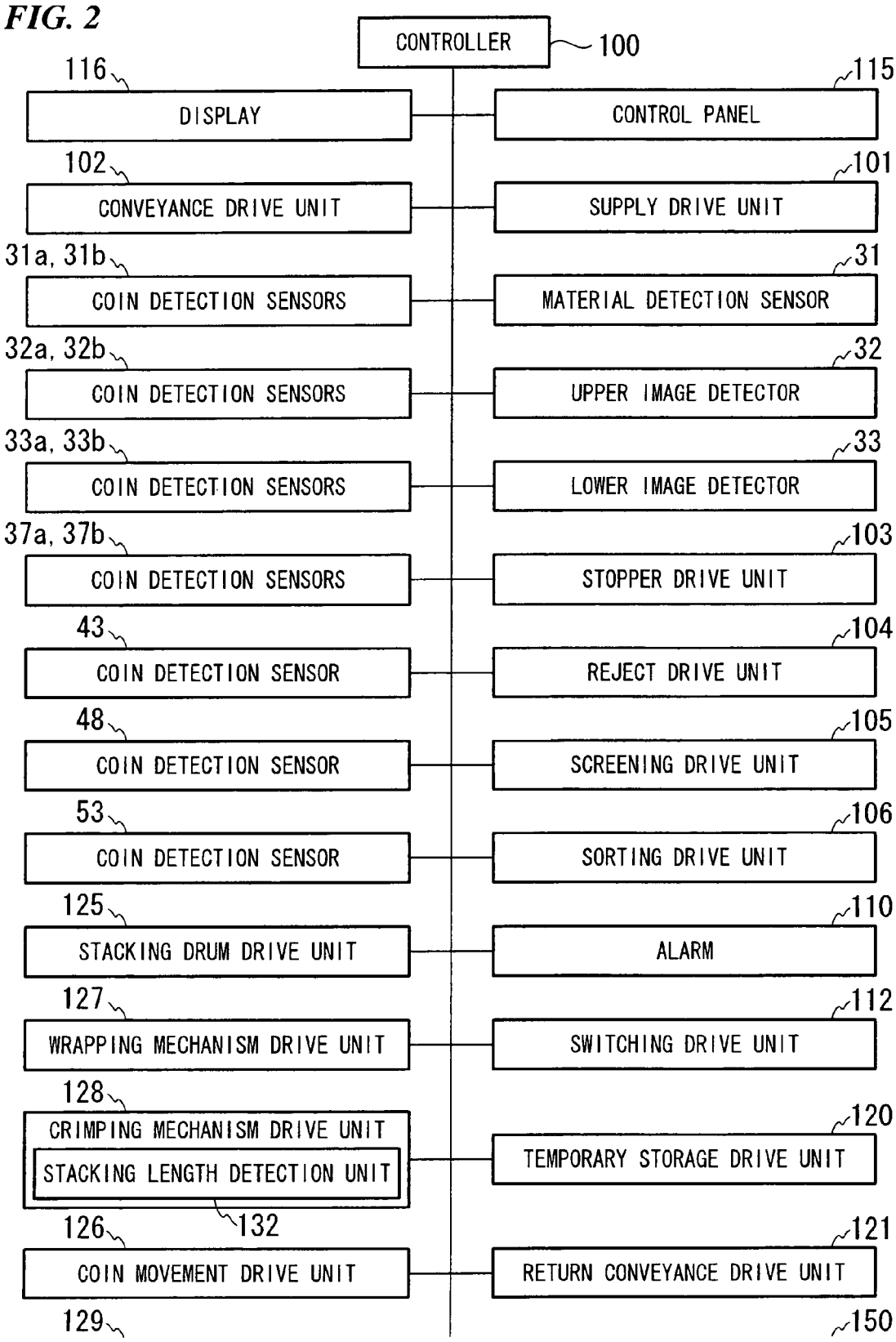
FIG. 2 is a block diagram of the control system of the coin wrapping machine according to the first embodiment of the present invention.

Coins which fall into the sorting aperture 46 are temporarily stored in a temporary storage unit (not shown) arranged under this sorting aperture 46. A temporary storage drive unit 120 shown in FIG. 2 is provided in the temporary storage unit. By the driving of this temporary storage drive unit 120, coins are transferred to a return conveyance unit 150 shown in FIG. 2. A return conveyance drive unit 121 shown in FIG. 2 is provided in the return conveyance unit 150. By the driving of this return conveyance drive unit 121, coins are returned to the supply disk 13 of the coin supply unit 10. In short, in the case where coins are wrapped by type in the wrapping mode, and in the case where coins are counted and dispensed by type in the counting mode, coins of a set type not subject to processing are guided to the temporary storage unit from the sorting aperture 46, and suitably returned to the supply disk 13. This temporary storage unit also enables removal of temporarily stored coins from the machine. In the case where only coins of the designated set type subject to processing are wrapped in the wrapping mode, and in the case where only coins of the designated set type subject to processing are separated and dispensed in the counting mode, coins different from a set type subject to processing, which are not designated, can be collected, and taken out of the machine from the temporary storage unit.

A sorting unit 50 is provided further downstream from the screening unit 45 of the second linear part 22. Based on the detection results of the upper image detector 32 and lower image detector 33, this sorting unit 50 further classifies as necessary true and regular coins which are coins of the designated set type subject to processing. Specifically, the sorting unit 50 has the prescribed coins continue further downstream on the coin channel 15, while removing other coins from the coin channel 15, with the result that the prescribed coins are sorted to a first side, and the other coins to a second side. This sorting unit 50 has the same configuration as the screening unit 45, and includes a sorting aperture 51, sorting projection 52, and sorting drive unit 106. The sorting aperture 51 is formed on the channel face of the second linear part 22. The sorting projection 52 is provided on the guide 17 side at the terminus position of the sorting aperture 51 on the upstream side in the coin conveyance direction, and is capable of projecting into the interior of the second linear part 22 and withdrawing from the interior of the second linear part 22. The sorting drive unit 106 shown in FIG. 2 contains a rotary solenoid (not shown) which causes the sorting projection 52 to rotate forward and backward at a prescribed angle.

In the state where the sorting projection 52 is withdrawn from the interior of the second linear part 22, coins which transit the sorting unit 50 move while being guided by contact with the guide 17 on whose side the sorting projection 52 is provided. The conveyor belt 28 and coin channel 15 are set up to enable movement of the coins in this manner. The width of the sorting aperture 51 is set narrower than the diameter of the smallest-diameter coins among the processed coins.

When the control device 100 establishes the state where the sorting projection 52 is withdrawn from the interior of the second linear part 22, the coins which always move in contact with the guide 17 are prevented from falling into the sorting aperture 51. These coins pass by the sorting aperture 51, and move further downstream on the second linear part 22. On the other hand, when the control device 100 drives the sorting drive unit 106, and compels the sorting projection 52 to project into the second linear part 22, the coins which have moved in contact with the guide 17 contact this sorting projection 52. Pushed by this sorting projection 52, the conveyance path of the coins is shifted so as to diverge from the guide 17. Consequently, the coins fall into the sorting aperture 51.

A coin detecting sensor 53 is provided at a position immediately before the sorting projection 52 on the upstream side of the second linear part 22. This coin detecting sensor 53 gauges the timing with which the sorting projection 52 is driven. By means of this configuration, the control device 100 drives the sorting drive unit 106 at a timing where the target coins are detected by this coin detecting sensor 53, and compels the sorting projection 52 to project into the second linear part 22 only at the prescribed times. By this means, it is possible to have only these target coins fall into the sorting aperture 51.

By making the sorting projection 52 project into the second linear part 22 in the foregoing manner, the sorting unit 50 compels those coins not sent to the stacking unit 71 from among true and regular coins which are of the designated set type subject to processing to fall into the sorting aperture 51, thereby ejecting them from the second linear part 22. On the other hand, by not making the sorting projection 52 project into the second linear part 22, coins which are sent to the stacking unit 71 from among true and regular coins which are of the designated set type subject to processing are not made to fall into the sorting aperture 51, and are conveyed further downstream on the second linear part 22.

The coins which fall into the sorting aperture 51 are directly transferred to the aforementioned return conveyance unit 150 shown in FIG. 2 via a chute (not shown), and are returned to the supply disk 13 of the coin supply unit 10 by this return conveyance unit 150.

A separator 55 is provided at the second bent part 23 downstream from the aforementioned sorting unit 50. This separator 55 separates the coins on the coin channel 15 into coins which are conveyed further downstream on the coin channel 15 and coins which are removed from the coin channel 15.

This separator 55 has a separation aperture **56*a*, a shutter member 56, and a switching drive unit 112. The separation aperture 56*a* is formed in the channel face of the second bent part 23. The shutter member 56 opens and closes the separation aperture 56*a*. The switching drive unit 112 shown in FIG. 2 drives the opening and closing of the shutter member 56. In the case where counting processing is selected as the operational content, the control device 100 puts the shutter member 56 into an open state by driving the switching drive unit 112. As a result, all coins of the set type subject to processing which have been conveyed downstream from the sorting unit 50 fall into the separation aperture 56*a***.

The coins which have been made to fall into the separation aperture **56*a* in this manner are guided by a counting conveyance path 81 and a counting chute 80, and introduced into an extraction box (not shown). In short, when the counting mode is selected as the operational content, the shutter member 56** is set to the open state, with the result that coins of the set type subject to processing are introduced into the extraction box from the separation aperture 56*a*. Subsequently, an operator removes the extraction box from the coin wrapping machine, and takes these coins of the set type subject to processing out of this removed extraction box. On the other hand, in the case where the wrapping mode is selected as the operational content, the control device 100 puts the shutter member 56 into a closed state. As a result, all coins of the set type subject to processing which have been conveyed downstream from the sorting unit 50 do not fall into the separation aperture 56*a*, and are led to the third linear part 24.

A coin wrapping unit 70 is provided in this third linear part 24. The coin wrapping unit 70 stacks the coins, which have been discriminated by the discrimination unit 34 as coins of the set type subject to processing and which have been conveyed to the third linear part 24, into a columnar shape (cylindrical or rolled shape) with the prescribed number of coins, and wraps this stack of coins.

The coin wrapping unit 70 is provided with a stacking unit 71, wrapping unit 72, and coin moving unit 73. The stacking unit 71 stacks a prescribed number of the coins which have been conveyed to the third linear part 24, and forms columnar stack of coins. The wrapping unit 72 forms wrapped coins by winding wrapping paper around the circumferential face of the stack of coins stacked by the stacking unit 71, and crimping the two ends. The coin moving unit 73 conveys the stack of coins formed by the stacking unit 71 toward the wrapping unit 72.

The stacking unit 71 has a pair of stacking drums 75 and 75, rear regulating plate, front regulating plate, and stacking drum drive unit 125. The pair of stacking drums 75 and 75 is each provided with a vertical axis, and each has a helical protrusion 74. The rear regulating plate (not shown) is vertically erected at the rear side between these stacking drums 75 and 75, and regulates the movement of coins by the inclination of the projections 74 and 74. The front regulating plate (not shown) is arranged opposite the rear regulating plate with interposition of the stacking drums 75 and 75. The stacking drum drive unit 125 shown in FIG. 2 rotates the stacking drums 75 and 75 in mutually opposite directions in synchronization with the supply of coins from the third linear part 24 in a state where the mutual height positions of the opposed parts of the protrusions 74 and 74 are made to match. By means of this configuration, the coins supplied through the third linear part 24 are mounted onto the protrusions 74 and 74 of the stacking drums 75 and 75, in a state where forward and rearward movement is regulated by the front regulating plate and rear regulating plate. Next, coins mounted onto the protrusions 74 and 74 are descend by a thickness of a coin due to rotation of the stacking drums 75 and 75 by the stacking drum drive unit 125. Thereafter, the coin which is supplied next stacks on top of the foregoing coin. As a result, multiple coins are vertically stacked in a pile between these stacking drums 75 and 75 and the regulating plates, thereby forming a stack of coins. With the coins keeping their position when they were on the coin channel 15 (their orientation in a vertical direction on the coin channel 15; hereinafter the same), the coins are transferred as is to the stacking drums 75 and 75, and stacked. In short, even when coins which adopt a position where the front face is oriented upward and the rear face is oriented downward on the coin channel 15 are transferred to the stacking drums 75 and 75, they keep the position where the front face is oriented upward and the rear face is oriented downward. On the other hand, even when coins which adopt a position where the rear face is oriented upward and the front face is oriented downward on the coin channel 15 are transferred to the stacking drums 75 and 75, they keep the position where the rear face is oriented upward and the front face is oriented downward.

The coin moving unit 73 has a support post 77 and coin moving drive unit 126. The support post 77 is arranged so as to move freely in the vertical direction on the underside of the stacking unit 71, and supports the stack of coins received from the stacking unit 71 from below. The coin moving drive unit 126 shown in FIG. 2 moves among a standby position where the stack of coins are received from the stacking unit 71, a wrapping position where wrapping operations are conducted by the wrapping unit 72, and a deposit position where, when stack of coins fall short, they are deposited into an odd-size storage box which stores these.

Figure 3:
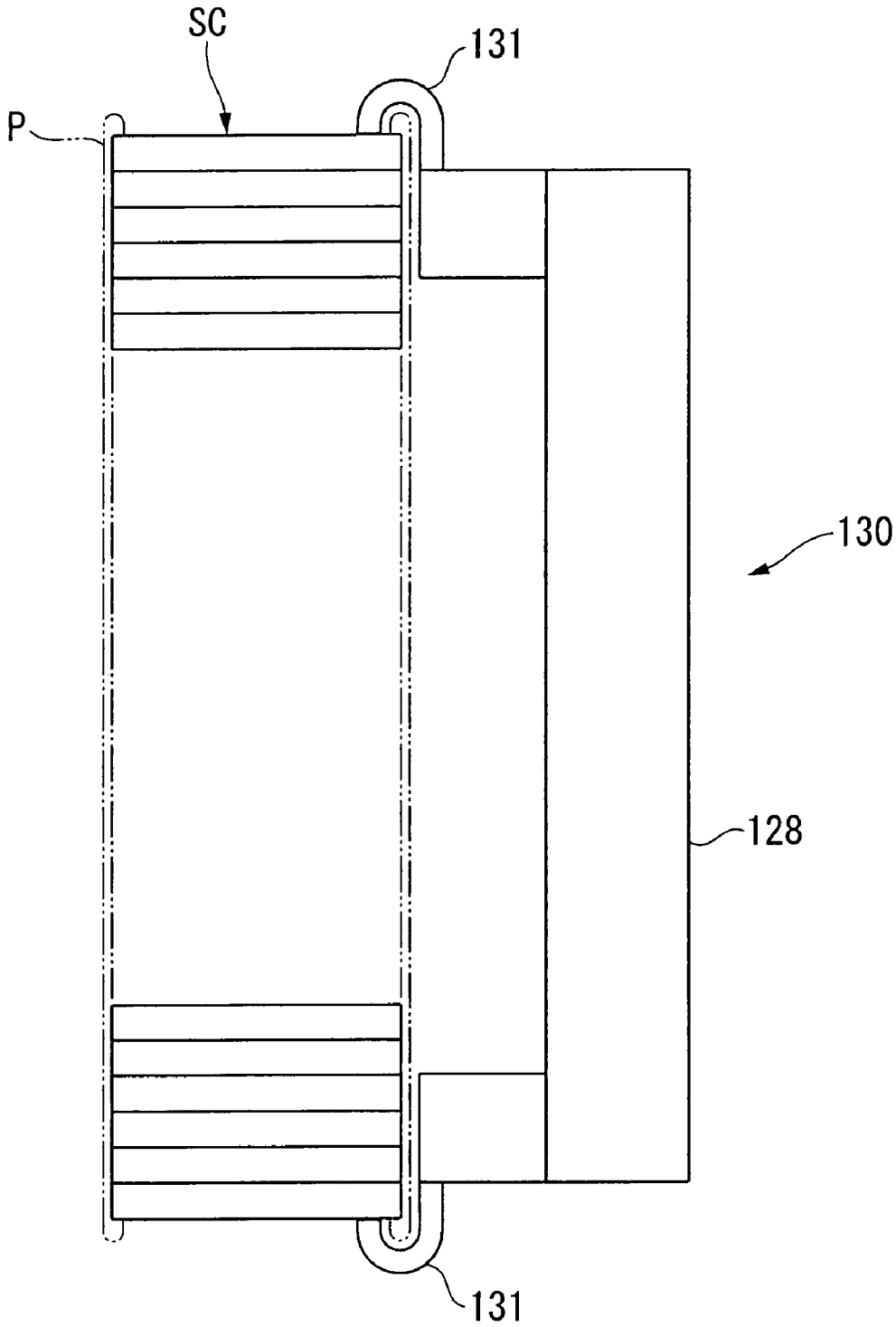
FIG. 3 is a frontal view showing the crimping mechanism in the coin wrapping machine according to the first embodiment of the present invention.

The wrapping unit 72 is arranged on opposite the side of the third linear part 24 to the stacking unit 71. This wrapping unit 72 is provided with a wrapping mechanism (not shown), wrapping mechanism drive unit 127 shown in FIG. 2, crimping mechanism 130, crimping mechanism drive unit 128 shown in FIG. 2, coin-roll conveyor (not shown), coin-roll conveyor drive unit 129 shown in FIG. 2, regular coin-roll housing (not shown), and odd coin-roll housing (not shown). Although not shown in the drawings, the wrapping mechanism supplies and winds wrapping paper around the circumference of a stack of coins supported by the support post 77 of the coin moving unit 73 positioned at the wrapping position. The wrapping mechanism drive unit 127 drives the wrapping mechanism. As shown in FIG. 3, the crimping mechanism 130 crimps the wrapped wrapping paper P at the top and edge ends of the stack of coins SC. The crimping mechanism drive unit 128 drives the crimping mechanism 130. The coin-roll conveyor transports the wrapped coins after wrapping. The coin-roll conveyor drive unit 129 drives the coin-roll conveyor. The regular coin-roll housing holds regular wrapped coins, which are directed to one side and conveyed by the coin-roll conveyor, so that they can be taken out of the machine. The odd coin-roll housing holds wrapped coins that are over- or undersized, which are directed to the other side and conveyed by the coin-roll conveyor, so that they can be taken out of the machine.

The crimping mechanism 130 shown in FIG. 3 has a pair of crimping claws 131 which approaches the stack of coins from both sides in the stacking direction of the stack of coins SC, and crimps the wrapping paper P which is wound around the periphery of the stack of coins. The crimping mechanism drive unit 128 is provided with a stack length detector 132 shown in FIG. 2 which detects the actual stack length of the stack of coins SC by bringing these crimping claws 131 into contact with the two end faces of the stack of coins SC in the stacking direction.

The coin wrapping machine includes a control panel (processing start control panel) 115 containing a keyboard on which operation modes are input conducted by the operator, and a display 116 containing a liquid crystal screen which conducts display toward the operator. The control panel 115 is capable of inputting a start command that serves to start wrapping processing.

Next, the operations of coin wrapping machine of the first embodiment are described.

As described above, the coin wrapping machine of the first embodiment is capable of processing in a wrapping mode which stacks and wraps deposited coins every prescribed number and is capable of processing in a counting mode which counts and classifies the deposited coins. The wrapping mode is further capable of processing in a wrapping format by issuing country which divides each denomination by the respective issuing country to conduct wrapping, and a wrapping format integrating issuing countries which wraps each denomination with intermixture of the respective issuing countries. The counting mode is also capable of processing in a counting format by issuing country which divides each denomination by issuing country to conduct separate counting and a counting format integrating issuing countries which conducts separate counting of each denomination with intermixture of the respective issuing countries.

Below, of the aforementioned types of processing, operations are described for the case where processing is selected in the wrapping format by issuing country of the wrapping mode according to the present invention.

First, in a state where the wrapping format by issuing country of the wrapping mode is selected via the control panel 115, the operator deposits loose coins in the supply disk 13 of the coin supply unit 10 via the hopper 12. Subsequently, a start command which serves to start wrapping processing is inputted into the control panel 115. In compliance with the start command, the control device 100 drives the supply drive unit 101, rotates the supply disk 13 and rotating disk 14, drives the conveyance drive unit 102, and rotates the conveyor belts 27A-27C and 28, whereupon the coins are supplied from the supply disk 13 to the rotating disk 14. Next, the coins are dispensed one-by-one from the rotating disk 14 to the coin channel 15. By means of the conveyor belts 27A-27C and 28, the coins are then conveyed on the first linear part 20 on the upstream side of the coin channel 15, and subsequently conveyed on the second linear part 22 on the downstream side via the first bent part 21. While the coins are being conveyed on this first linear part 20 and second linear part 22, the control device 100 not only conducts counting, but also discrimination with respect to the truth/falsehood, regularity/irregularity, denomination, issuing country, and front/rear positioning of each coin based on the detection results of the discrimination unit 34 which is arranged so as to span this first linear part 20 and second linear part 22. This discrimination unit 34 is composed of the material detection sensor 31, upper image detector 32, and lower image detector 33.

Based on the detection results of the material detection sensor 31, upper image detector 32, and lower image detector 33, the control device 100 conveys detected coins which are discriminated as true and regular further downstream on the coin channel 15 without allowing them to fall into the reject aperture 41 of the reject unit 40. On the other hand, with respect to detected coins which are discriminated as abnormal coins from the detection results of the material detection sensor 31, upper image detector 32 and lower image detector 33, the detection results containing the respective detection images of the upper image detector 32 and lower image detector 33 are stored in memory (this memory not shown is provided on the control device 100). Furthermore, the stopper drive unit 103 is driven at the timing where the coin detection sensors 37*a* and 37*b* detect this abnormal coin, the stopper members 36*a* and 36*b* are made to project into the interior of the second linear part 22, and the passage of this abnormal coin is blocked. Simultaneous with this, driving of the supply disk 13 and rotating disk 14 by the supply drive unit 101 is stopped. Subsequently, when all of the coins which are downstream from this abnormal coin which has been stopped by the stopper members 36*a* and 36*b* are eliminated from the coin channel 15, the driving of conveyors 27A-27C and 28 and the belt 29 by the conveyance drive unit 102 is stopped, and conveyance of coins following this abnormal coin is stopped.

The control device 100 then displays on the display 116 the discrimination factor for which the detected coin was discriminated as an abnormal coin. For example, the discrimination factor pertaining to the abnormal coin is considered to be a factor pertaining to the detection image of at least one or the other of the upper image detector 32 and lower image detector 33. In that case, the control device 100 causes display on the display 116 of the detection image of at least one or the other of the upper image detector 32 and lower image detector 33 pertaining to this abnormal coin. Furthermore, the error factor of this abnormal coin is displayed in text.

Next, from the display on the display 116, the operator perceives the content of the discrimination factor pertaining to the abnormal coin, and also checks the actual front/rear detection image which is displayed.

During the above-described stoppage by the stopper members 36*a* and 36*b*, the operator conducts a confirmatory input into the control panel 115 after having checked the display on the display 116. Upon receiving this, the control device 100 drives the stopper drive unit 103, compels withdrawal of the stopper members 36*a* and 36*b* from the interior of the second linear part 22, and cancels the state of stoppage of the abnormal coin. At the same time, the supply drive unit 101 is driven, the supply disk 13 and rotating disk 14 are rotated, the conveyance drive unit 102 is driven, and the conveyor belts 27A-27C and 28 and the belt 29 are rotated, thereby restarting downstream conveyance of coins following the abnormal coin by the conveyor belts 27A-27C and 28.

Next, the control device 100 drives the reject drive unit 104 at the timing where the coin detection sensor 43 detects this abnormal coin, compelling the reject projection 42 to project into the second linear part 22 only at the prescribed time. As a result, only this abnormal coin is made to fall into the reject aperture 41 from the coin channel 15. This fallen coin is recovered in the reject box (not shown). The operator then immediately takes the reject box out of the coin wrapping machine, and removes the abnormal coin from this reject box, thereby obtaining the abnormal coin confirmed by detection images in the aforementioned manner When input of a wrapping processing start command is conducted to the control panel in a state where the wrapping format by issuing country of the wrapping mode is selected as described above, the control device 100 sets the set type subject to wrapping processing to a denomination (single denomination) and issuing country (single country) for the coin which is first discriminated as true and regular after input of the wrapping processing start command.

Thereafter, of the coins discriminated as true and regular coins based on the detection results of the discrimination unit 34, the control device 100 compels coins different from a set type subject to processing, which is other than the designated set type subject to processing, to fall into the sorting aperture 46 in the screening unit 45, and temporarily stores them in the temporary storage unit. On the other hand, coins of the single denomination and single issuing country of the designated set type subject to processing are sent downstream on the coin channel 15 toward the stacking unit 71 without falling into the sorting aperture 46 in the screening unit 45. In short, the screening unit 45 classifies the coins as coins of the set type subject to processing and as coins different from a set type subject to processing, which differs from the set type subject to processing. Coins of the set type subject to processing are sorted to the first side (downstream on the coin channel 15) and coins different from a set type subject to processing, which differs from the set type subject to processing, are sorted to the second side (temporary storage unit).

Among coins of the single denomination and single issuing country of the set type subject to processing which are sent downstream toward the stacking unit 71 without falling in the screening unit of the coin channel 15, in the case where they are sent to the stacking unit 71, the control device 100 conducts discrimination of the coin to be stacked first and undermost in the stack of coins in the stacking unit 71. In this discrimination, it is determined based on the detection results of the upper image detector 32 and lower image detector 33 whether the orientation is such that the front face is upward and the rear face downward, or whether the orientation is such that the rear face is upward and the front face downward. In the case where this coin has an orientation where the rear face is upward and the front face downward, it is made to fall into the sorting aperture 51 in the sorting unit 50. Furthermore, the return conveyance drive unit 121 is driven, and it is supplied again to the supply disk 13 of the coin supply unit 10 via the return conveyance unit 150. In short, the return conveyor 150 resupplies the supply disk 13 with the coin that fell into the sorting aperture 51 of the sorting unit 50. If this coin is followed by coins with the same orientation, all such coins are made to fall into the sorting aperture 51 of the sorting unit 50.

On the other hand, if sent to the stacking unit 71, in the case where the coin that is stacked first has an orientation where the front face is upward and the rear face downward, the control device 100 sends this coin to the stacking unit 71 on the coin channel 15 without having it fall into the sorting aperture 51 of the sorting unit 50. Coins which are conveyed to the stacking unit 71 by the coin conveyance unit 25 are sequentially stacked in the stacking unit 71 with the same orientation as when conveyed by the coin conveyance unit 25, that is, with an orientation identical to the front-rear orientation that was discriminated by the discrimination unit 34. Consequently, a coin which is sent with an orientation where the front face is upward and rear face downward, which is stacked first, and which is undermost is retained in the stacking unit 71 with an orientation where the front face is upward and rear face downward.

After the coin which stacked first in the stacking unit 71 has been sent in the foregoing manner, the control device 100 sends coins with the single denomination and single issuing country of the designated set type subject to processing to the stacking unit 71 without regard to the orientation of the coins. As a result, in the stacking unit 71, a stack of coins is formed where the subsequently conveyed coins are sequentially stacked upward in a columnar shape on top of the coin that was stacked first. An outside face of a coin at one end of a stack of coins (a coin positioned on one edge of a stack of coins) is referred to as a first outside face is referred to as the first outside face of the stack of coins. The coin configuring the first outside face is stacked first among a stack of cons. Moreover, an outside face of a coin at the other end of a stack of coins (a coin positioned on the other edge of the stack of coins) is referred to as the second outside face of the stack of coins. The coin configuring the second outside face is stacked last among a stack of coins. The first outside face and second outside face of the stack of coins are respectively visible faces.

The control device 100 determines from the counting results of the discrimination unit 34 that a coin conveyed to the stacking unit 71 which is a coin with the single denomination and single issuing country of the designated set type subject to processing has reached the wrapping unit number (e.g., 50 coins), whereupon the coins which are upstream from this coin are stopped by the stopper members 36*a* and 36*b*. When all coins up to the wrapping unit number are stacked in the stacking unit 71, wrapping paper P is wound around the circumference of the stack of coins SC by the wrapping unit 72, and the parts of the wrapping paper P which project from the two ends of the stack of coins SC (the upper and lower ends of the wrapping paper P which is wrapped around the circumferential face of the stack of coins SC) are crimped by the pair of crimping claws 131 to produce the wrapped coins (that is, wrapped stack of coins).

With respect to the wrapped coins produced in this manner, of the outside faces of the stack of coins (the visible faces, the faces which do not contact any of the other coins in the stack of coins, and the faces which are on the reverse side of the faces that contact another coins), the first outside face is always the rear face of coin. The coin forming the first outside face is stacked first.

When the wrapping paper P is crimped by the pair of crimping claws 131, the pair of crimping claws 131 comes into contact with the two end parts of the stack of coins SC in the stacking direction. The stack length detector 132 detects the actual stack length of the stack of coins SC from the distance between the pair of crimping claws 131 at the time of this contact.

The control device 100 compares the preselected standard stack length of stack of coins SC which is preset in memory with the actual stack length. As a result, if their difference is within the allowable range, it is determined that the detected stack of coins is normal. On the other hand, if the aforementioned difference is outside the allowable range, it is determined that the detected stack of coins is over- or undersized. In the case where the detected stack of coins—that is, the wrapped coins—is normal and neither over- nor undersized, these wrapped coins are conveyed to the regular coin-roll housing by the coin-roll conveyor. On the other hand, if the stack of coins—that is, the wrapped coins—is over- or undersized, it is conveyed to the odd coin-roll housing by the coin-roll conveyor. Please note that it is also acceptable to determine odd sizes by the weight of the wrapped coins.

The control device 100 cancels the conveyance control of the coins by the stopper members 36*a* and 36*b* at the appropriate timing where the coins to be stacked next in the stacking unit 71 do not interfere with the stack of coins sent to the wrapping unit 72. It also drives the supply drive unit 101 and conveyance drive unit 102. In the manner described above, it repeats the operations that it has the coins stacked in the stacking unit 71 for the next wrapping, and it has the coins wrapped when the coins have been stacked up to the wrapping unit number.

As described above, all of the loose coins deposited in the supply disk 13 become wrapped coins which are stored in the regular coin-roll housing or odd coin-roll housing, or are recovered in the reject box, or are temporarily stored in the temporary storage unit, or are stacked in the stacking unit 71 until they are eliminated from the supply disk 13, rotating disk 14 and coin channel 15, whereupon a shift to the next operation ensues. Next, the control device 100 stores those coins which are in the process of stacking and which have not reached the stack number in the stacking unit 71 in the odd-size storage box. Subsequently, coins different from a set type subject to processing which have been temporarily stored in the temporary storage unit are supplied to the supply disk 13, and the same processing described above is repeated. At this time, after coins different from a set type subject to processing which have been temporarily stored in the temporary storage unit have been supplied to the supply disk 13, the denomination (single denomination) and issuing country (single country) of the coin which is first discriminated as true and regular by the discrimination unit 34 are set as the next set type subject to wrapping processing.

The coin wrapping machine of the first embodiment described above wraps coins which form a pattern common to all issuing countries containing denomination information on the front face, and which form a pattern that differs by issuing country on the rear face. On such occasions, the control device 100 controls the sorting unit 50 based on the discrimination results of the discrimination unit 34 so that the face which is an end face of the stack of coins pertaining to either of the two coins at the two ends of the stack of coins configured by stacking the prescribed number of coins in the stacking unit 71 is always the rear face on which the pattern that differs by issuing country is formed. In short, in the case where it is determined based on the discrimination results of the discrimination unit 34 that the coin to be stacked first if sent into the stacking unit 71 is being conveyed with an orientation where the first outside face of the stack of coins is a rear face, the control device 100 has that coin sorted to the first side by the sorting unit 50, and sent into the stacking unit 71. On the other hand, in the case where it is determined based on the discrimination results of the discrimination unit 34 that the coin to be stacked first if sent into the stacking unit 71 is being conveyed with an orientation where the first outside face of the stack of coins is not a rear face (front orientation), the control device 100 has that coin sorted to the second side by the sorting unit 50. The stack of coins which are stacked in this manner are then wrapped by the wrapping unit 72. Consequently, with respect to the wrapped coins, the first outside face of the stack of coins is always the rear face of the coin on which is formed the pattern that differs by issuing country. Accordingly, it is possible to conduct wrapping so that the issuing country is unfailingly known after wrapping. Moreover, as the front-rear orientation of the coin to be stacked last is disregarded, one can reduce the possibility of sorting the coin to the return conveyance unit 150 for reasons of coin orientation. Note that it is unclear whether the second outside face of the stack of coins will be a front face or a rear face. However, if it is the front face of the coin, the denomination will be known from the displayed denomination information, and even if it is the rear face of the coin, the denomination will be known from the size of the diameter, coloration and so on.

Moreover, the control device 100 controls the sorting unit 50 so that the first outside face of the stack of coins is always the rear face on which the pattern that differs by issuing country is formed. Accordingly, even if a coin being conveyed with an orientation where the first outside face of the stack of coins would not be the rear face of the coin is sorted to the return conveyance unit 150, it is sorted at the beginning of the stacking. Consequently, this coin can be quickly provided for subsequent stacking, and automatically returned to the supply disk 13 of the coin supply unit 10 by the return conveyance unit 150.

Furthermore, after a wrapping processing start operation is inputted to the control panel 115, the type of coin first discriminated by the discrimination unit 34 is set as the set type subject to processing by the control device 100. Consequently, it is unnecessary to conduct an operation for setting the set type subject to processing, and simplification of operations is achieved. It is also acceptable to set the set type subject to processing by input to the control panel 115.

Next, the coin wrapping machine of a second embodiment of the present invention is described centering on the parts which differ from the first embodiment. The coin wrapping machine of the second embodiment partially differs from the first embodiment with respect to the processing of the wrapping format by issuing country of the wrapping mode.

In the second embodiment, as in the first embodiment, the control device 100 conducts processing based on the detection results of the upper image detector 32 and lower image detector 33 with respect to the coin to be stacked first if sent to the stacking unit 71 among coins of the single denomination and single issuing country of the set type subject to processing sent downstream toward the stacking unit 71 without falling into the screening unit 45 on the coin channel 15. If it is a coin with an orientation where the rear face is upward and front face downward, it is made to fall into the sorting aperture 51 of the sorting unit 50. Furthermore, the return conveyance drive unit 121 is driven, and it is supplied again to the supply disk 13 of the coin supply unit 10 via the return conveyance unit 150. On the other hand, in the case where it has an orientation where the front face is upward and rear face downward, it is sent to the stacking unit 71. By this means, the coin which is stacked first and undermost in the stacking unit 71 has an orientation where the front face is upward and rear face downward.

After the coin to be stacked first is sent to the stacking unit 71 in the above-described manner, the control device 100 sends the coins with the single denomination and single issuing country of the designated set type subject to processing to the stacking unit 71 without regard to front-rear orientation, except for the coin to be stacked last.

Among the coins of the single denomination and single issuing country of the set type subject to processing, the control device 100 conducts processing with respect to the coin to be stacked last and topmost in the stack of coins in the stacking unit 71 if sent to the stacking unit 71. The control device 100 determines based on the detection results of the upper image detector 32 and lower image detector 33 whether this coin has an orientation where the front face is upward and rear face downward, or whether it has an orientation where the rear face is upward and front face downward. In the case where this coin has an orientation where the rear face is upward and front face downward, it is made to fall into the sorting aperture 51 of the sorting unit 50. Furthermore, the return conveyance drive unit 121 is driven, and it is supplied again to the supply disk 13 of the coin supply unit 10 via the return conveyance unit 150. If followed by coins with the same orientation, these coins are all made to fall into the sorting aperture 51 in the sorting unit 50.

On the other hand, in the case where the coin to be stacked last if sent to the stacking unit 71 has an orientation where the front face is upward and rear face downward, the control device 100 sends this coin on the coin channel 15 to the stacking unit 71 without having it fall into the sorting aperture 51 of the sorting unit 50, whereupon this coin is stacked as the coin to be stacked last among the stack of coins with an orientation where the front face is upward and rear face downward.

When coins which are discriminated as true and regular and which are of the single denomination and single issuing country of the designated set type subject to processing reach the wrapping unit number (e.g., 50 coins), a shift to the next operation ensues. Subsequently, as in the first embodiment, wrapping paper P is wound around the periphery of the stack of coins SC by the wrapping unit 72, and the parts of the wrapping paper P which project from the two ends of the stack of coins SC are crimped by the pair of crimping claws 131 to produce the wrapped coins.

With respect to the wrapped coins produced in this manner, one of the two coins at the two ends of the stack of coins is the coin which is stacked first. The face which is the end face of the stack of coins pertaining to this coin that was stacked first (the first outside face of the stack of coins) is always the rear face. Moreover, the other of the two coins at the two ends of the stack of coins in the stacking direction is the coin which is stacked last. The face which is the end face of the stack of coins pertaining to this coin that was stacked last (the second outside face of the stack of coins) is always the front face.

According to the coin wrapping machine of the second embodiment described above, the control device 100 controls the sorting unit 50 so that the first outside face of the stack of coins is always the rear face on which the pattern that differs by issuing country is formed. On the other hand, the sorting unit 50 is controlled so that the second outside face of the stack of coins is always the front face on which the pattern common to issuing countries containing the denomination information is formed. In short, in the case where it is determined based on the discrimination results of the discrimination unit 34 that the coin to be stacked last if sent into the stacking unit 71 is being conveyed with an orientation where the face which is the other end face of the stack of coins (the second outside face) would be the front face, the control device 100 has that coin sorted to the first side by the sorting unit 50, and sent into the stacking unit 71. On the other hand, in the case where it is determined based on the discrimination results of the discrimination unit 34 that the coin to be stacked last if sent into the stacking unit 71 is being conveyed with an orientation where the face which is the other end face of the stack of coins (second outside face) would not be the front face (a rear face orientation), the control device 100 has that coin sorted to the return conveyance unit 150 of the second side by the sorting unit 50. Accordingly, the first outside face of the stack of coins is the rear face, and the second outside face of the stack of coins is the front face. Consequently, it is possible to conduct wrapping so that the issuing country is unfailingly known after wrapping. Moreover, it is possible to conduct wrapping so that the denomination is also easily known.

Next, the coin wrapping machine of a third embodiment of the present invention is described centering on the parts which differ from the first embodiment. The coin wrapping machine of the third embodiment partially differs from the first embodiment with respect to the processing of the wrapping format by issuing country of the wrapping mode.

In the third embodiment, the control device 100 sends, regardless of orientation, the coin to be stacked first and undermost in the stack of coins in the stacking of the stacking unit 71 among coins of the single denomination and single issuing country of the set type subject to processing sent downstream toward the stacking unit 71 without falling into the screening unit 45 on the coin channel 15 to the stacking unit 71. That is, the face of the coin to be stacked first which is one of the end faces of the stack of coins may be either a front face or rear face. At the time, based on the detection results of the upper image detector 32 and lower image detector 33, it is determined with respect to this coin to be stacked first whether it is a coin with an orientation where the rear face is upward and front face downward, or a coin with an orientation where the front face is upward and rear face downward.

In the case where the coin to be stacked first is a coin with an orientation where the rear face is downward and front face upward, the control device 100 sends coins of the single denomination and single issuing country of the set type subject to processing from this coin to be stacked first until the coin to be stacked last to the stacking unit 71 without regard to front-rear orientation, and has them stacked.

When the coins which are of the single denomination and single issuing country of the designated set type subject to processing and which have been discriminated as true and regular reach the wrapping unit number (e.g., 50 coins) in this manner, the next processing is conducted. Next, as in the first embodiment, wrapping paper P is wound around the circumference of the stack of coins SC in the wrapping unit 72, and the parts of the wrapping paper P which project from the two ends of the stack of coins SC in the stacking direction are crimped by the pair of crimping claws 131 to produce wrapped coins.

With respect to the wrapped coins produced in this manner, of the first outside face and second outside face of the stack of coins, at least the first outside face is the rear face of the coin.

On the other hand, in the case where the coin to be stacked first is a coin with an orientation where the rear face is upward and front face downward, the control device 100 sends coins of the single denomination and single issuing country of the set type subject to processing from this coin to be stacked first until the coin which is one before the coin to be stacked last to the stacking unit 71 without determining the orientation of the coin faces, and has them stacked. The control device 100 then makes a determination with respect to the coin to be stacked last and topmost in the stack of coins in the stacking unit 71 if sent to the stacking unit 71 among the coins of the single denomination and single issuing country of the set type subject to processing. That is, based on the detection results of the upper image detector 32 and lower image detector 33, it is determined with respect to the coin to be stacked last and topmost whether it has an orientation where the front face is upward and rear face downward, or an orientation where the rear face is upward and front face downward. In the case where this coin has an orientation where the front face is upward and rear face downward, it is made to fall into the sorting aperture 51 of the sorting unit 50. Furthermore, the return conveyance drive unit 121 is driven, and it is supplied again to the supply disk 13 of the coin supply unit 10 via the return conveyance unit 150. If followed by coins with the same orientation, these coins are all made to fall into the sorting aperture 51 in the sorting unit 50.

On the other hand, in the case where the coin to be stacked last if sent to the stacking unit 71 has an orientation where the rear face is upward and front face downward, the control device 100 sends this coin on the coin channel 15 to the stacking unit 71 without having it fall into the sorting aperture 51 of the sorting unit 50, whereupon this coin is stacked as the coin to be stacked last among the stack of coins with an orientation where the rear face is upward and front face downward.

When the coins which are of the single denomination and single issuing country of the designated set type subject to processing and which have been discriminated as true and regular reach the wrapping unit number (e.g., 50 coins) in this manner, a shift to the next processing ensues. In the next processing, as in the first embodiment, wrapping paper P is wound around the circumference of the stack of coins SC in the wrapping unit 72, and the parts of the wrapping paper P which project from the two ends of the stack of coins SC are crimped by the pair of crimping claws 131 to produced wrapped coins.

With respect to the wrapped coins produced in this manner, of the first outside face and second outside face of the stack of coins, the second outside face is the rear face of the coin.

According to the coin wrapping machine of the third embodiment described above, the control device 100 allows the first outside face of the stack of coins to be either a front face or rear face. In addition, it controls the sorting unit 50 so that the second outside face is always the rear face, but only in the case where the first outside face is not the rear face on which the pattern that differs by issuing country is formed. In short, in the case where it is determined based on the discrimination results of the discrimination unit 34 that the coin to be stacked last if sent into the stacking unit 71 is being conveyed with an orientation where the second outside face would be the rear face, the control device 100 has that coin sorted to the first side by the sorting unit 50, and sent into the stacking unit 71. On the other hand, in the case where it is determined based on the discrimination results of the discrimination unit 34 that the coin to be stacked last if sent into the stacking unit 71 is being conveyed with an orientation where the second outside face would not be the rear face, the control device 100 has that coin sorted to the second side by the sorting unit 50, and sent to the return conveyance unit 150. Accordingly, at least one of the two end faces of the stack of coins is the rear face of the coin. Accordingly, it is possible to conduct wrapping so that the issuing country is unfailingly known after wrapping. Moreover, the coins are stacked without regard to the front-rear orientation of the coin to be stacked first. Accordingly, one can reduce the possibility of coins being sorted to the return conveyance unit 150 for the reason that they do not have the desired orientation.

Next, the coin wrapping machine of a fourth embodiment of the present invention is described centering on the parts which differ from the first embodiment. The coin wrapping machine of the fourth embodiment partially differs from the first embodiment with respect to the processing of the wrapping format by issuing country of the wrapping mode.

In the fourth embodiment, the control device 100 sends, regardless of orientation, the coin to be stacked first and undermost in the stack of coins in the stacking unit 71 among coins of the single denomination and single issuing country of the set type subject to processing sent downstream toward the stacking unit 71 without falling into the screening unit 45 on the coin channel 15 to the stacking unit 71 (it is possible for the face of the coin to be stacked first which is an end face of the stack of coins to be either a front face or rear face). At the time, based on the detection results of the upper image detector 32 and lower image detector 33, it is determined with respect to this coin to be stacked first whether it is a coin with an orientation where the rear face is upward and front face downward, or a coin with an orientation where the front face is upward and rear face downward, and this determination is stored in memory. The control device 100 then sends coins of the single denomination and single issuing country of the set type subject to processing from this coin to be stacked first until the coin which is one before the coin to be stacked last to the stacking unit 71 without regard to front-rear orientation, and has them stacked.

The control device 100 makes a determination with respect to the coin to be stacked last and topmost in the stack of coins in the stacking unit 71 if sent to the stacking unit 71 among the coins of the single denomination and single issuing country of the set type subject to processing. That is, based on the detection results of the upper image detector 32 and lower image detector 33, it is determined with respect to the coin to be stacked last and topmost whether it has an orientation where the front face is upward and rear face downward, or an orientation where the front face is downward and rear face upward. Furthermore, this is compared with the front-rear orientation of the aforementioned coin to be stacked first. In the case where the orientations of the coin to be stacked first and the coin to be stacked last if sent to the stacking unit 71 are reversed, the following operations are conducted. That is, the coin to be stacked last if sent to the stacking unit 71 is made to fall into the sorting aperture 51 of the sorting unit 50, the return conveyance drive unit 121 is driven, and this coin is supplied again to the supply disk 13 of the coin supply unit 10 via the return conveyance unit 150. If followed by coins with the same orientation, these coins are all made to fall into the sorting aperture 51 in the sorting unit 50. Specifically, the foregoing case is, firstly, the case where the coin to be stacked first has an orientation where the front face is upward and rear face downward, and the coin to be stacked last if sent to the stacking unit 71 has an orientation where the rear face is upward and front face downward. Secondly, it is the case where the coin to be stacked first has an orientation where the rear face is upward and front face downward, and the coin to be stacked last if sent to the stacking unit 71 has an orientation where the front face is upward and rear face downward.

On the other hand, in the case where the orientations of the coin to be stacked first and the coin to be stacked last if sent to the stacking unit 71 are identical, the coin to be stacked last if sent to the stacking unit 71 are sent on the coin channel 15 to the stacking unit 71 without falling into the sorting aperture 51 in the sorting unit 50. Specifically, the foregoing case is, firstly, the case where the coin to be stacked first has an orientation where the front face is upward and rear face downward, and the coin to be stacked last has an orientation where the front face is upward and rear face downward. Secondly, it is the case where the coin to be stacked first has an orientation where the rear face is upward and front face downward, and the coin to be stacked last has an orientation where the rear face is upward and front face downward. In the aforementioned cases, the coin to be stacked last and topmost has an orientation identical to that of the coin that is stacked first.

When the coins which are of the single denomination and single issuing country of the designated set type subject to processing and which have been discriminated as true and regular reach the wrapping unit number (e.g., 50 coins) in this manner, a shift to the next processing ensues. Next, as in the first embodiment, wrapping paper P is wound around the circumference of the stack of coins SC in the wrapping unit 72, after which the parts of the wrapping paper P which project from the two ends of the stack of coins SC in the stacking direction are crimped by the pair of crimping claws 131 to produce wrapped coins.

With respect to the wrapped coins produced in this manner, the first and second outside faces which are the end faces of the stack of coins are faces where the front and rear of the coins are respectively reversed. Consequently, one of the end faces of the stack of coins is the rear face of the coin, and the other end face of the stack of coins is the front face of the coin.

According to the coin wrapping machine of the fourth embodiment described above, the control device 100 allows the first outside face of the stack of coin to be either a front face or rear face. In addition, it controls the sorting unit 50 so that the second outside face of the stack of coins is a face where the front-rear orientation is the reverse of the first outside face of the stack of coins. The specific control method is as follows. First, if the first outside face of the stack of coins is a front face, division into the following two cases is then made. Firstly, there is the case where it is determined based on the discrimination results of the discrimination unit 34 that the coin to be stacked last if sent into the stacking unit 71 is being conveyed with an orientation where the second outside face, which is the other end face of the stack of coins, would be the rear face. In this case, the control device 100 has that coin sorted to the first side by the sorting unit 50, and sent into the stacking unit 71. Secondly, there is the case where it is determined based on the discrimination results of the discrimination unit 34 that the coin to be stacked last if sent into the stacking unit 71 is being conveyed with an orientation where the second outside face, which is the other end face of the stack of coins, would not be the rear face. In this case, the control device 100 has that coin sorted to the return conveyance unit 150 of the second side by the sorting unit 50. If the first outside face which is one of the end faces of the stack of coins and which pertains to the coin to be stacked first is a rear face, division into the following two cases is then made.

Firstly, there is the case where it is determined based on the discrimination results of the discrimination unit 34 that the coin to be stacked last if sent into the stacking unit 71 is being conveyed with an orientation where the second outside face, which is the other end face of the stack of coins, would be the front face. In this case, the control device 100 has that coin sorted to the first side by the sorting unit 50, and sent into the stacking unit 71. Secondly, there is the case where it is determined based on the discrimination results of the discrimination unit 34 that the coin to be stacked last if sent into the stacking unit 71 is being conveyed with an orientation where the second outside face, which is the other end face of the stack of coins, would not be the front face. In this case, the control device 100 has the coin sorted to the second side by the sorting unit 50. Accordingly, one of the end faces of the stack of coins is the front face of the coin, and the other end face of the stack of coins is the rear face of the coin. Accordingly, it is possible to conduct wrapping so that the issuing country is unfailingly known after wrapping, and it is also possible to conduct wrapping so that the denomination is easily known.

What is claimed is:

1. A coin wrapping machine which wraps coins that form a common pattern, which contains denomination information, on a front face and that form a pattern on a rear face that differs according to a plurality of issuing countries, comprising:

a supply unit which dispenses deposited coins one-by-one;

a coin conveyance unit which conveys the coins dispensed from said supply unit;

a discrimination unit which detects images of the front face and the rear face of the coins conveyed by said coin conveyance unit, discriminates the coins, and obtains discrimination results;

a sorting unit which sorts the coins conveyed by said coin conveyance unit to one of prescribed coins to be stacked and other coins based on the discrimination results;

a stacking unit which stacks the coins sorted to the prescribed coins by said sorting unit into columnar form with a prescribed number of coins;

a wrapping unit which wraps a stack of coins stacked into the columnar form by said stacking unit; and a controller which controls said sorting unit so that at least one of a first outside face of a first coin at one end of the stack of coins and a second outside face of a second coin at the other end of the stack of coins is the rear face, wherein said controller controls said sorting unit so that in the case where it is determined based on the discrimination results that a coin to be stacked first in said stacking unit is being conveyed by said coin conveyance unit with an orientation where a face that would be the first outside face is the rear face, the coin is sorted to the prescribed coins, and in the case where it is determined based on the discrimination results that a coin to be stacked first in said stacking unit is being conveyed by said coin conveyance unit with an orientation where a face that would be the first outside face is the front face, the coin is sorted to the other coins, so that the first outside face is made to be the rear face.

2. The coin wrapping machine according to claim 1, further comprising a return conveyance unit that resupplies the coins sorted to the other coins by said sorting unit to said supply unit.

3. The coin wrapping machine according to claim 1, further comprising a control panel which inputs a start command in order to start wrapping processing, wherein upon input of the start command by said control panel, said controller designates a type of a coin initially discriminated by said discrimination unit to a set type subject to the wrapping processing.

4. The coin wrapping machine according to claim 1, wherein said controller controls said sorting unit so that in the case where it is determined based on said discrimination results that a coin to be stacked last in said stacking unit is being conveyed by said coin conveyance unit with an orientation where a face that would be the second outside face is the front face, the coin is sorted to the prescribed coins, and in the case where it is determined based on said discrimination results that a coin to be stacked last in said stacking unit is being conveyed by said coin conveyance unit with an orientation where the face that would be the second outside face is the rear face, the coin is sorted to the other coins, so that the second outside face is made to be the front face.

5. The coin wrapping machine according to claim 4, further comprising a return conveyance unit that resupplies the coins sorted to the other coins by said sorting unit to said supply unit.

6. The coin wrapping machine according to claim 4, further comprising a control panel which inputs a start command in order to start wrapping processing, wherein upon input of the start command by said control panel, said controller designates a type of a coin initially discriminated by said discrimination unit to a set type subject to the wrapping processing.

7. A coin wrapping machine which wraps coins that form a common pattern, which contains denomination information, on a front face and that form a pattern on a rear face that differs according to a plurality of issuing countries, comprising:

a supply unit which dispenses deposited coins one-by-one;

a coin conveyance unit which conveys the coins dispensed from said supply unit;

a discrimination unit which detects images of the front face and the rear face of the coins conveyed by said coin conveyance unit, discriminates the coins, and obtains discrimination results;

a sorting unit which sorts the coins conveyed by said coin conveyance unit to one of prescribed coins to be stacked and other coins based on the discrimination results;

a stacking unit which stacks the coins sorted to the prescribed coins by said sorting unit into columnar form with a prescribed number of coins;

a wrapping unit which wraps a stack of coins stacked into the columnar form by said stacking unit; and a controller which controls said sorting unit so that at least one of a first outside face of a first coin at one end of the stack or coins and a second outside face of a second coin at the other end of the stack of coins is the rear face, wherein said controller controls said sorting unit so that in the case where it is determined based on said discrimination results that a coin to be stacked last in said stacking unit is being conveyed by said coin conveyance unit with an orientation where a face that would be the second outside face is the rear face, the coin is sorted to the prescribed coins, and in the case where it is determined based on said discrimination results that a coin to be stacked last in said stacking unit is being conveyed by said coin conveyance unit with an orientation where the face that would be the second outside face is the front face, the coin is sorted to the other coins, so that the second outside face is made to be the rear face.

8. The coin wrapping machine according to claim 7, further comprising a return conveyance unit that resupplies the coins sorted to the other coins by said sorting unit to said supply unit.

9. The coin wrapping machine according to claim 7, further comprising a control panel which inputs a start command in order to start wrapping processing, wherein upon input of the start command by said control panel, said controller designates a type of a coin initially discriminated by said discrimination unit to a set type subject to the wrapping processing.

10. A coin wrapping machine which wraps coins that form a common pattern, which contains denomination information, on a front face and that form a pattern on a rear face that differs according to a plurality of issuing countries, comprising:

a supply unit which dispenses deposited coins one-by-one;

a coin conveyance unit which conveys the coins dispensed from said supply unit;

a discrimination unit which detects images of the front face and the rear face of the coins conveyed by said coin conveyance unit, discriminates the coins, and obtains discrimination results;

a sorting unit which sorts the coins conveyed by said coin conveyance unit to one of prescribed coins to be stacked and other coins based on the discrimination results;

a stacking unit which stacks the coins sorted to the prescribed coins by said sorting unit into columnar form with a prescribed number of coins;

a wrapping unit which wraps a stack of coins stacked into the columnar form by said stacking unit; and a controller which controls said sorting unit so that at least one of a first outside face of a first coin at one end of the stack of coins and a second outside face of a second coin at the other end of the stack of coins is the rear face, wherein, only when the first outside face is to be the front face, said controller controls said sorting unit so that in the case where it is determined based on said discrimination results that a coin to be stacked last in said stacking unit is being conveyed by said coin conveyance unit with an orientation where a face that would be the second outside face is the rear face, the coin is sorted to the prescribed coins, and in the case where it is determined based on said discrimination results that a coin to be stacked last in said stacking unit is being conveyed by said coin conveyance unit with an orientation where the face that would be the second outside face is the front face, the coin is sorted to the other coins, so that the second outside face is made to be the rear face.

11. The coin wrapping machine according to claim 10, further comprising a return conveyance unit that resupplies the coins sorted to the other coins by said sorting unit to said supply unit.

12. The coin wrapping machine according to claim 10, further comprising a control panel which inputs a start command in order to start wrapping processing, wherein upon input of the start command by said control panel, said controller designates a type of a coin initially discriminated by said discrimination unit to a set type subject to the wrapping processing.

13. A coin wrapping machine which wraps coins that form a common pattern, which contains denomination information, on a front face and that form a pattern on a rear face that differs according to a plurality of issuing countries, comprising:

a supply unit which dispenses deposited coins one-by-one;

a coin conveyance unit which conveys the coins dispensed from said supply unit;

a discrimination unit which detects images of the front face and the rear face of the coins conveyed by said coin conveyance unit, discriminates the coins, and obtains discrimination results;

a sorting unit which sorts the coins conveyed by said coin conveyance unit to one of prescribed coins to be stacked and other coins based on the discrimination results;

a stacking unit which stacks the coins sorted to the prescribed coins by said sorting unit into columnar form with a prescribed number of coins;

a wrapping unit which wraps a stack of coins stacked into the columnar form by said stacking unit; and a controller which controls said sorting unit so that at least one of a first outside face of a first coin at one end of the stack of coins and a second outside face of a second coin at the other end of the stack of coins is the rear face, wherein, when the first outside face is to be the front face, said controller controls said sorting unit so that in the case where it is determined based on said discrimination results that a coin to be stacked last in said stacking unit is being conveyed by said coin conveyance unit with an orientation where a face that would be the second outside face is the rear face, the coin is sorted to the prescribed coins, and in the case where it is determined based on said discrimination results that a coin to be stacked last in said stacking unit is being conveyed by said coin conveyance unit with an orientation where the face that would be the second outside face is the front face, the coin is sorted to the other coins, so that the second outside face is made to be opposite in front-rear face of coin to the first outside face, wherein, when the first outside face is to be the rear face, said controller controls said sorting unit so that in the case where it is determined based on said discrimination results that a coin to be stacked last in said stacking unit is being conveyed by said coin conveyance unit with an orientation where a face that would be the second outside face is the front face, the coin is sorted to the prescribed coins, and in the case where it is determined based on said discrimination results that a coin to be stacked last in said stacking unit is being conveyed by said coin conveyance unit with an orientation where the face that would be the second outside face is the rear face, the coin is sorted to the other coins, so that the second outside face is made to be opposite in front-rear face of coin to the first outside face.

14. The coin wrapping machine according to claim 13, further comprising a return conveyance unit that resupplies the coins sorted to the other coins by said sorting unit to said supply unit.

15. The coin wrapping machine according to claim 13, further comprising a control panel which inputs a start command in order to start wrapping processing, wherein upon input of the start command by said control panel, said controller designates a type of a coin initially discriminated by said discrimination unit to a set type subject to the wrapping processing.

* * * * *